US010876550B2

(12) United States Patent
Asaba et al.

(10) Patent No.: US 10,876,550 B2
(45) Date of Patent: Dec. 29, 2020

(54) PRESSURE BOOSTER

(71) Applicant: SMC CORPORATION, Chiyoda-ku (JP)

(72) Inventors: Tsuyoshi Asaba, Abiko (JP); Tadashi Igarashi, Koshigaya (JP); Ryosuke Sato, Tsukubamirai (JP)

(73) Assignee: SMC CORPORATION, Chiyoda-ku (JP)

( * ) Notice: Subject to any disclaimer, the term of this patent is extended or adjusted under 35 U.S.C. 154(b) by 0 days.

(21) Appl. No.: 16/603,059

(22) PCT Filed: Feb. 26, 2018

(86) PCT No.: PCT/JP2018/006850
§ 371 (c)(1),
(2) Date: Oct. 4, 2019

(87) PCT Pub. No.: WO2018/186048
PCT Pub. Date: Oct. 11, 2018

(65) Prior Publication Data

US 2020/0072249 A1 Mar. 5, 2020

(30) Foreign Application Priority Data

Apr. 7, 2017 (JP) ..... 2017-076416

(51) Int. Cl.
*F15B 9/08* (2006.01)

(52) U.S. Cl.
CPC ..... *F15B 9/08* (2013.01)

(58) Field of Classification Search
CPC .. F01L 23/00; F04B 9/12; F04B 9/129; F04B 9/131; F04B 9/135; F15B 9/08
See application file for complete search history.

(56) References Cited

U.S. PATENT DOCUMENTS 2,925,782 A * 2/1960 Sharpe ..... F04B 9/135 417/345
3,354,912 A * 11/1967 Gordon ..... F15B 13/04 137/625.69

(Continued)

FOREIGN PATENT DOCUMENTS

CN 106402055 A 2/2017
DE 325269 C * 9/1920 ..... F01L 23/00
JP 10-267002 A 10/1998

OTHER PUBLICATIONS

International Search Report and Written Opinion dated May 23, 2018 in PCT/JP2018/006850 filed Feb. 26, 2018.

(Continued)

*Primary Examiner* — Michael Leslie
*Assistant Examiner* — Matthew Wiblin
(74) *Attorney, Agent, or Firm* — Oblon, McClelland, Maier & Neustadt, L.L.P.

(57) ABSTRACT

A pressure booster is equipped with a pair of cylinders provided on both sides of a center unit, pistons each disposed inside the pair of cylinders, and a piston rod connecting the pistons. Each of the cylinders has a drive chamber and a booster chamber partitioned by the piston therein, and wherein the pressure booster is further equipped with a switching valve that is switched by abutting on each of the pistons, and a reset valve disposed in a fluid passage connecting a supply port to one of the pair of drive chambers.

4 Claims, 7 Drawing Sheets

(56) References Cited

U.S. PATENT DOCUMENTS

| | | | | | |
|---|---|---|---|---|---|
| 4,634,350 | A * | 1/1987 | Credle, Jr. | B67D 1/103 | 417/393 |
| 4,674,958 | A * | 6/1987 | Igarashi | F01L 23/00 | 417/225 |
| 4,767,282 | A | 8/1988 | Igarashi et al. | | |
| 4,827,831 | A * | 5/1989 | Hartley | F01B 31/02 | 137/625.27 |
| 5,554,011 | A * | 9/1996 | Bales | F01L 23/00 | 417/399 |
| 5,676,033 | A * | 10/1997 | Szabo | F15B 13/0402 | 91/303 |
| 6,422,834 | B1 * | 7/2002 | Bahrton | F04B 9/115 | 137/106 |
| 6,619,932 | B2 * | 9/2003 | Murata | F04B 43/0736 | 417/392 |
| 6,644,940 | B2 * | 11/2003 | Yamada | F04B 43/0081 | 417/384 |
| 7,175,395 | B1 * | 2/2007 | Forest | F04B 9/115 | 417/225 |
| 7,980,270 | B2 * | 7/2011 | Bertsch | F04B 43/026 | 137/625.68 |
| 9,127,657 | B2 * | 9/2015 | Glauber | F04B 9/133 | |
| 2008/0223206 | A1 * | 9/2008 | Igarashi | F15B 21/12 | 92/12.1 |

OTHER PUBLICATIONS

Combined Chinese Office Action and Search Report dated Apr. 24, 2020 in Chinese Patent Application No. 201880022961.9 (with English translation), 14 pages.

* cited by examiner

PRESSURE BOOSTER

TECHNICAL FIELD

The present invention relates to a pressure booster for boosting and outputting a pressure fluid by the reciprocating motion of pistons.

BACKGROUND ART

Heretofore, there is known a pressure booster equipped with cylinders provided on opposite sides of a center unit, pistons slidable in these cylinders, and a piston rod enabling the pistons to reciprocate integrally. In this pressure booster, each cylinder is partitioned by a piston into a booster chamber on an inner side and a drive chamber on an outer side. When the piston on one side is slid by the supply of compressed air from a switching valve to the drive chamber on the one side, compressed air in the booster chamber of the cylinder on the one side is boosted to be outputted. Then, the switching valve is switched when the piston comes close to a stroke end, and next, pressurized air is supplied to the drive chamber of the cylinder on the other side, whereby the compressed air in the boost chamber of the cylinder on the other side is boosted to be outputted. By the repetition of this operation, it is possible to boost and output the pressure fluid continuously.

In a field of a switching valve of a pressure booster, the applicant of the present application has proposed a switching valve made up from a main valve that is operated by air supplied to and discharged from a pilot chamber for switching a driving compressed air to a pair of drive chambers to output the driving compressed air, and pilot valves that are operated by being pressed by the pistons to supply or discharge air to the pilot chamber (see Japanese Laid-Open Patent Publication No. 10-267002).

SUMMARY OF INVENTION

The present invention has been made in connection with the aforementioned proposal, and it is an object of the present invention to provide a pressure booster capable of being restarted easily even when a switching valve is stopped at a neutral position due to a drop in pressurized fluid supplied thereto or the like.

A pressure booster according to the present invention features comprising a center unit, a pair of cylinders provided on both sides of the center unit, pistons each disposed insides the pair of cylinders, a piston rod connecting the pair of pistons, a supply port supplied with pressure fluid, an output port for outputting boosted pressure fluid, and an exhaust port for discharging the pressure fluid, wherein the cylinders each have a booster chamber and a drive chamber partitioned by the piston, and wherein the pressure booster further comprises a switching valve that is switched by abutting on each of the pistons to make one or the other of the pair of drive chambers communicate with the supply port and to make the other or one of the pair of drive chambers communicate with the exhaust port, and a reset valve disposed in a fluid passage connecting the supply port and one of the pair of drive chambers.

According to the pressure booster described above, it is possible to be easily restarted even when the switching valve is stopped at a neutral position due to a drop in pressurized fluid supplied thereto or the like.

In the aforementioned pressure booster, it is preferable that the switching valve is incorporated into the center unit and is equipped with a pair of push rods being respectively abuttable on the pistons and a spool slid by the pair of push rods. With this construction, the switching valve becomes simple, operating mechanically.

Further, it is preferable that the reset valve is constituted as a normally closed valve which is switchable to a communication state or a cutoff state between the supply port and one of the pair of drive chambers and which is manually switchable to a communication position. With this construction, it is possible to manually restart the pressure booster reliably even when the switching valve is stopped at the neutral position.

In this case, the reset valve may be one which operates to be switched to the communication position when receiving as a pilot pressure the fluid pressure in one of the drive chambers. With this construction, even when the switching valve is stopped at the neutral position, the switching valve is operated to restart the pressure booster when the fluid pressure in one of the drive chambers is higher than a predetermined value.

Furthermore, it is preferable that the reset valve is incorporated into the center unit. With this construction, it is possible to simplify a flow passage configuration employed for disposition of the reset valve.

The pressure booster according to the present invention is provided with the reset valve that is disposed in the flow passage connecting the supply port to one of the pair of drive chambers and is capable of being restarted easily even when the switching valve is stopped at the neutral position due to a drop in fluid pressure supplied thereto or the like.

The above and other objects, features and advantages of the present invention will become more apparent from the following description when taken in conjunction with the accompanying drawings, in which preferred embodiments of the present invention are shown by way of illustrative examples.

DESCRIPTION OF EMBODIMENTS

Figure 1:
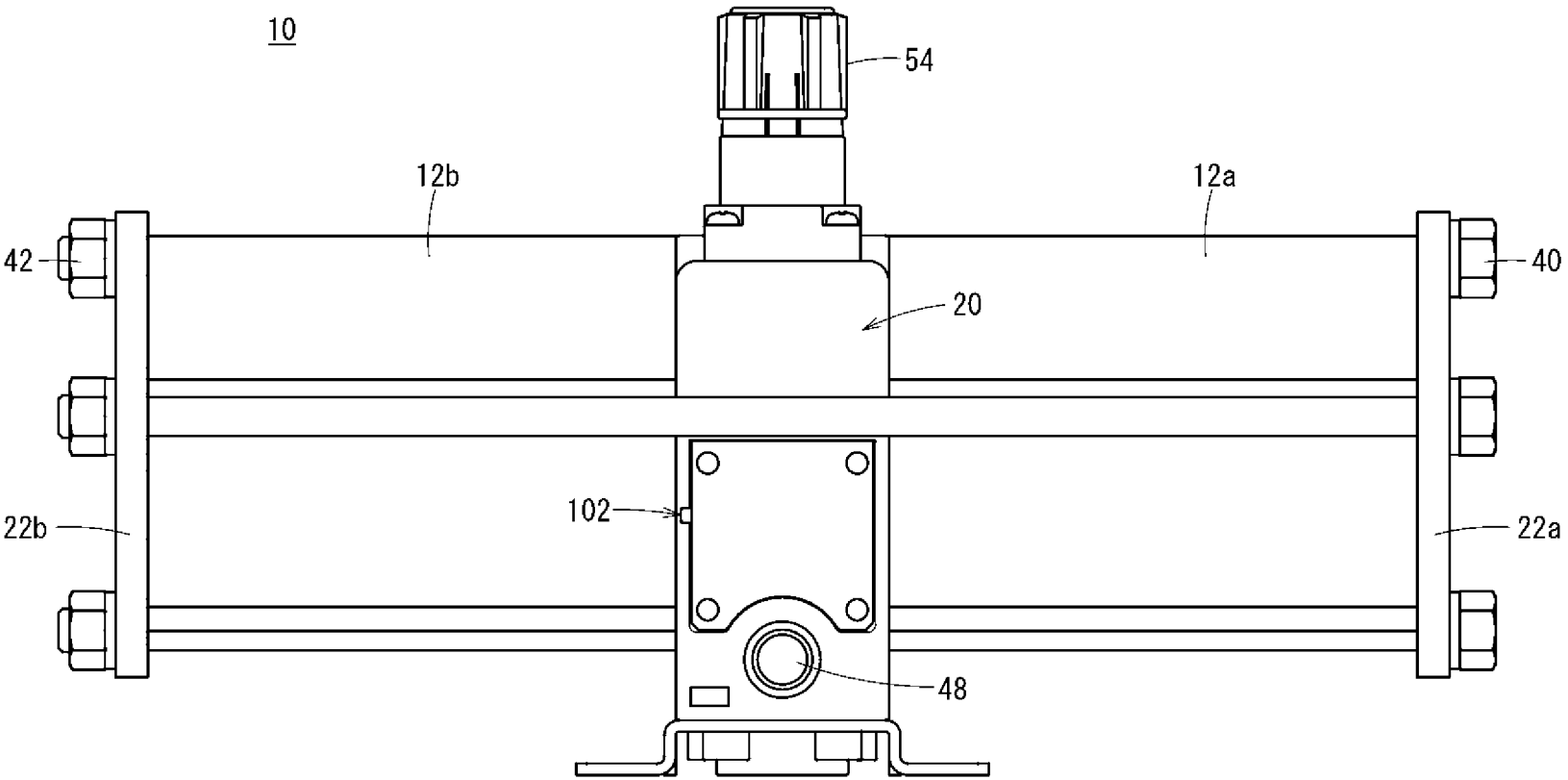
FIG. 1 is a front view of a pressure booster according to a first embodiment of the present invention.
Figure 2:
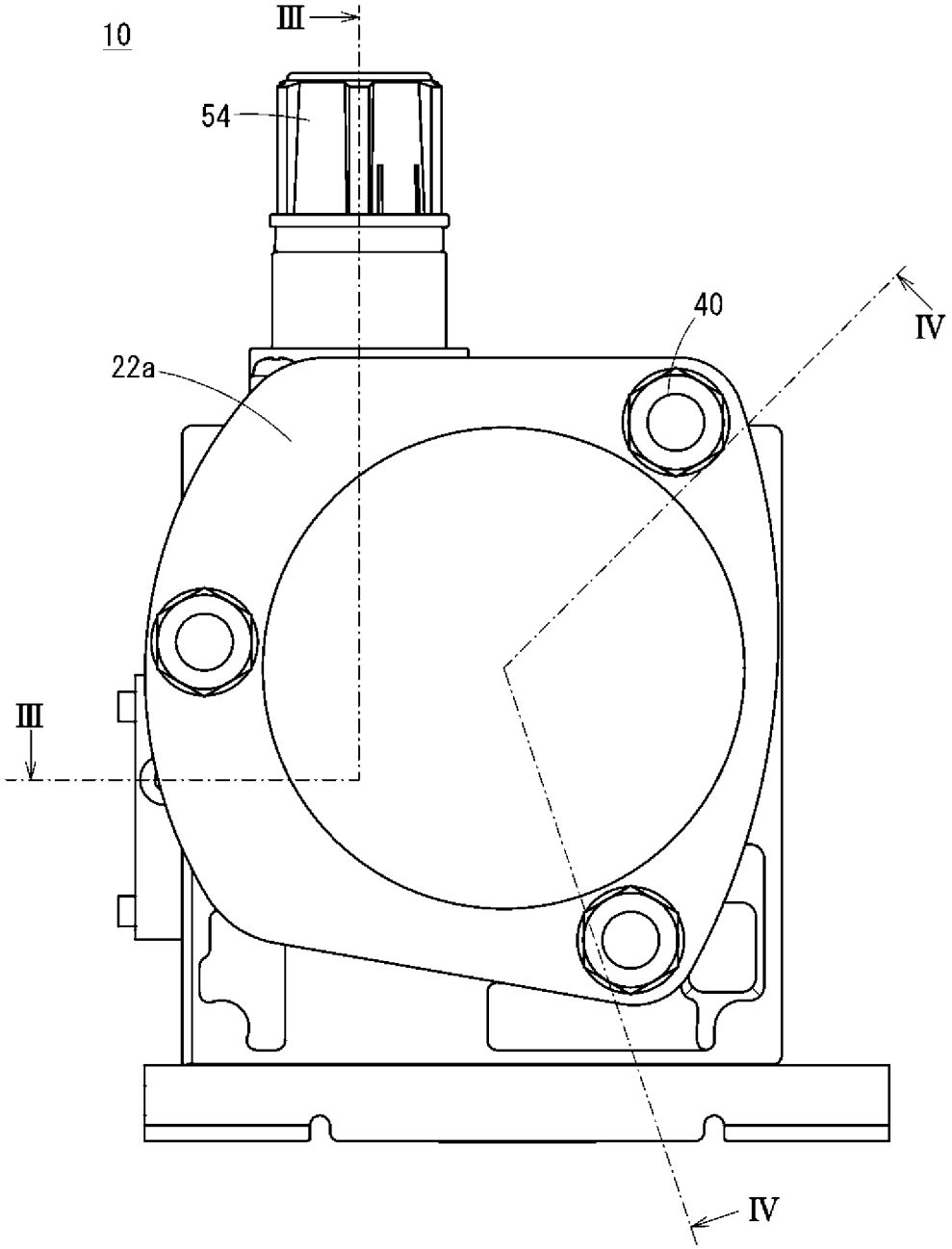
FIG. 2 is a right side view of the pressure booster shown in FIG. 1.

Hereafter, a pressure booster according to the present invention will be described based on preferred embodiments with reference to the accompanying drawings.

As shown in FIG. 1 to FIG. 4 and FIG. 6, reference numeral 10 denotes a pressure booster according to a first embodiment of the present invention. The pressure booster 10 in the present embodiment is arranged between a compressor (not shown) being a supply source of pressure fluid (pressurized air, compressed air) and an actuator (not shown) operated by boosted compressed air.

Figure 3:
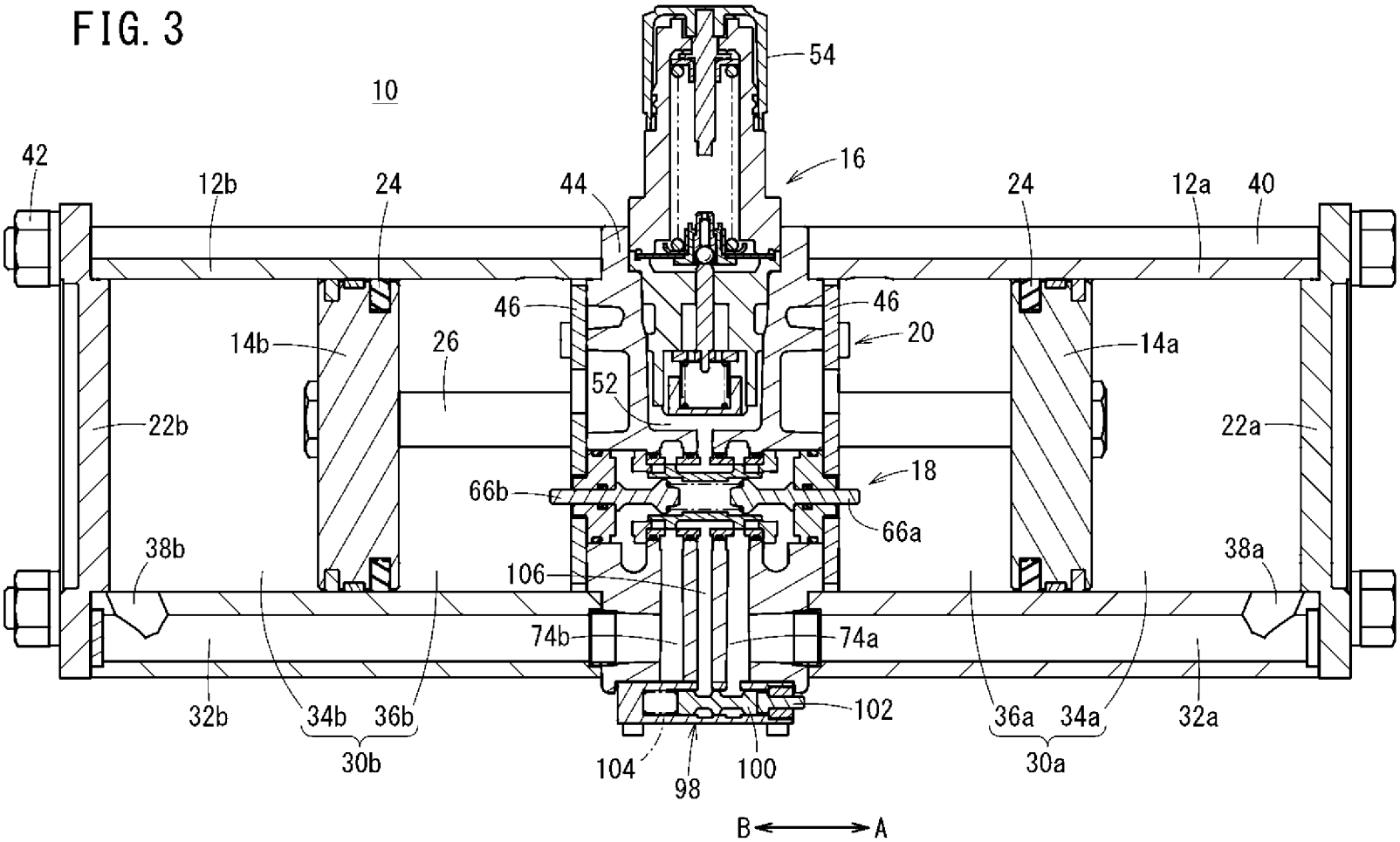
FIG. 3 is a sectional view taken along the line III-III in FIG. 2.

As shown in FIG. 3, the pressure booster 10 has a cylinder mechanism including a pair of cylinder tubes (cylinders) 12*a*, 12*b* and a pair of pistons 14*a*, 14*b* and also has a center unit 20 that is provided between the pair of cylinder tubes 12*a*, 12*b* and incorporates a regulating valve 16 and a switching valve 18.

The respective cylinder tubes 12*a*, 12*b* are formed in a cylindrical shape and are closed at their opposite ends by end plates 22*a*, 22*b*. The respective pistons 14*a*, 14*b* are movably disposed inside the cylinder tubes 12*a*, 12*b*, and a piston packing 24 is fitted in an annular groove on an outer surface of each piston 14*a*, 14*b*.

Figure 4:
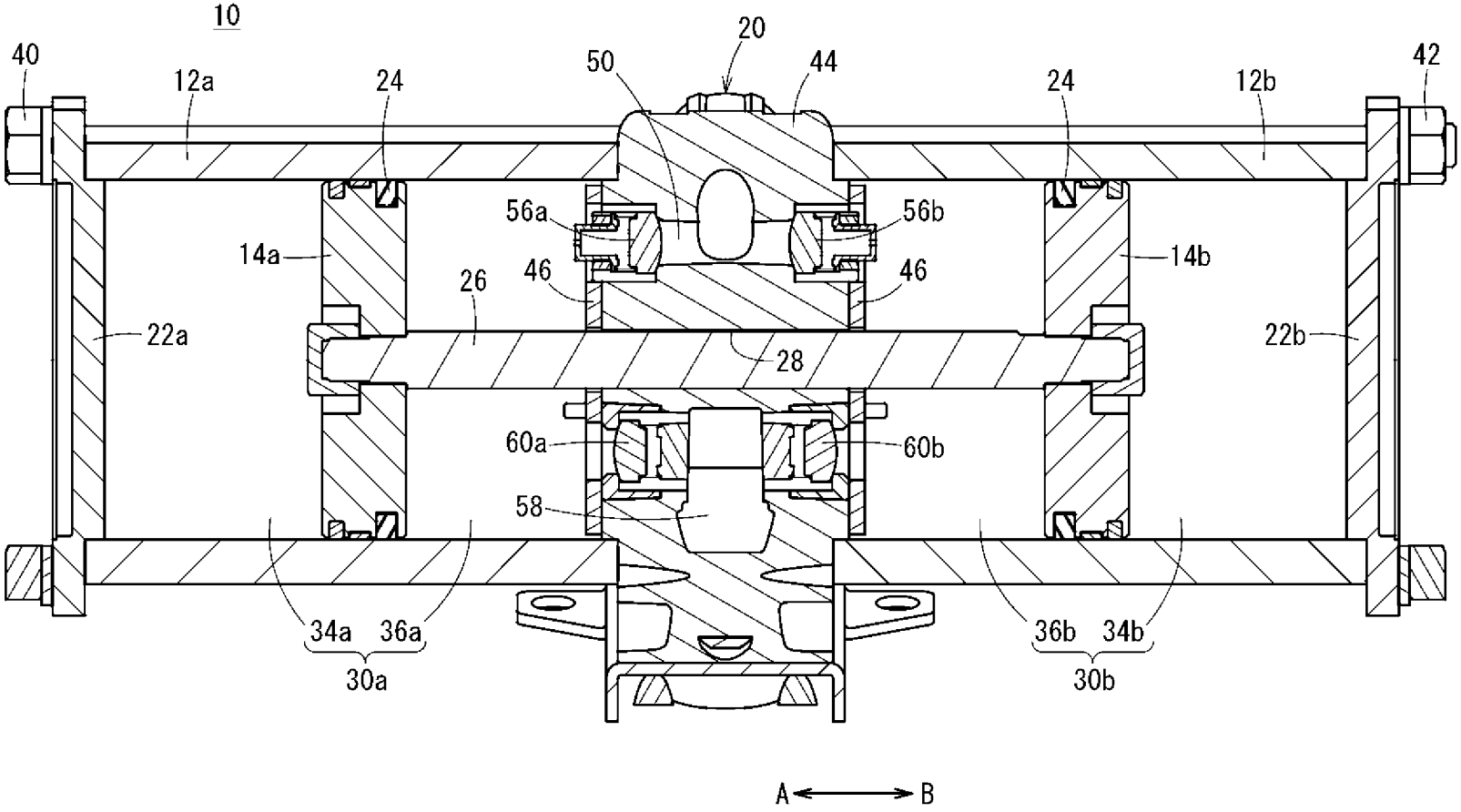
FIG. 4 is a sectional view taken along the line IV-IV in FIG. 2.

As shown in FIG. 4, the pair of pistons 14*a*, 14*b* is integrally connected to each other by a piston rod 26. The center unit 20 has a rod hole 28 at a central portion thereof. The rod hole 28 penetrates the center unit 20 in an axial direction (the arrow A-B direction), and the piston rod 26 that is movable is inserted into the rod hole 28.

As shown in FIG. 3, inside the respective cylinder tubes 12*a*, 12*b*, cylinder chambers 30*a*, 30*b* are formed into which the pistons 14*a*, 14*b* are inserted respectively. Fluid passages 32*a*, 32*b* are respectively formed in parallel to the cylinder chambers 30*a*, 30*b*. The respective fluid passages 32*a*, 32*b* are formed separately from the cylinder chambers 30*a*, 30*b* and communicate respectively with the cylinder chambers 30*a*, 30*b* on end sides of the cylinder tubes 12*a*, 12*b* where the end plates 22*a*, 22*b* are attached.

The respective cylinder chambers 30*a*, 30*b* are partitioned into drive chambers 34, 34*b* and booster chambers 36*a*, 36*b*, respectively. Each drive chamber 34*a*, 34*b* is provided between the piston 14*a*, 14*b* and the end plate 22*a*, 22*b*, and pressure fluid is supplied to or discharged from each drive chamber 34*a*, 34*b*. Each booster chamber 36*a*, 36*b* is provided between the piston 14*a*, 14*b* and the center unit 20 and operates to boost the pressure fluid. The respective fluid passages 32*a*, 32*b* communicate with the drive chambers 34*a*, 34*b* of the cylinder chambers 30*a*, 30*b* through first passages 38*a*, 38*b*, respectively.

Outside the cylinder tubes 12*a*, 12*b*, a plurality of tie rods 40 is inserted from one end plate 22*a* to the other end plate 22*b*, and end portions of the tie rods 40 protruding from the end plate 22*b* are tightened by nuts 42. Thus, the center unit 20 is held between the cylinder tube 12*a* and the cylinder tube 12*b*. The center unit 20 includes a center body 44 and a pair of side plates 46 attached to opposite ends of the axial direction (the arrow A-B direction) of the center body 44.

The center body 44 has a supply port 45 supplied with pressure fluid from the compressor, an output port 47 for outputting boosted pressure fluid toward an actuator (not shown), and an exhaust port 48 for discharging pressure fluid. The supply port 45 is connected to a lead-in passage 50 that is in the center body 44 communicating with the pair of booster chambers 36*a*, 36*b* (refer to FIG. 4) and is also connected to a supply passage 52 that is in the center body 44 communicating with either one of the pair of the fluid passages 32*a*, 32*b* through the switching valve 18 (refer to FIG. 3). The supply passage 52 is provided with the regulating valve 16 to which the pressure at the output port 47 is fed back, so that the flow rate of the pressure fluid can be regulated when a handle 54 provided on an upper portion of the center body 44 is rotated by the worker.

As shown in FIG. 4, between the lead-in passage 50 and the respective booster chambers 36*a*, 36*b*, there are provided first check valves 56*a*, 56*b* for allowing fluid flow from the lead-in passage 50 toward the booster chambers 36*a*, 36*b* but blocking fluid flow from the booster chambers 36*a*, 36*b* toward the lead-in passage 50. The output port 47 is connected to a lead-out passage 58 that is in the center body 44 communicating with the pair of booster chambers 36*a*, 36*b*. Between the lead-out passage 58 and the respective booster chambers 36*a*, 36*b*, there are provided second check valves 60*a*, 60*b* for allowing fluid flow from the booster chambers 36*a*, 36*b* toward the lead-out passage 58 but blocking fluid flow from the lead-out passage 58 toward the booster chambers 36*a*, 36*b*. The first check valves 56*a*, 56*b* and the second check valves 60*a*, 60*b* are incorporated into the center body 44 by the use of the side plates 46.

Figure 5:
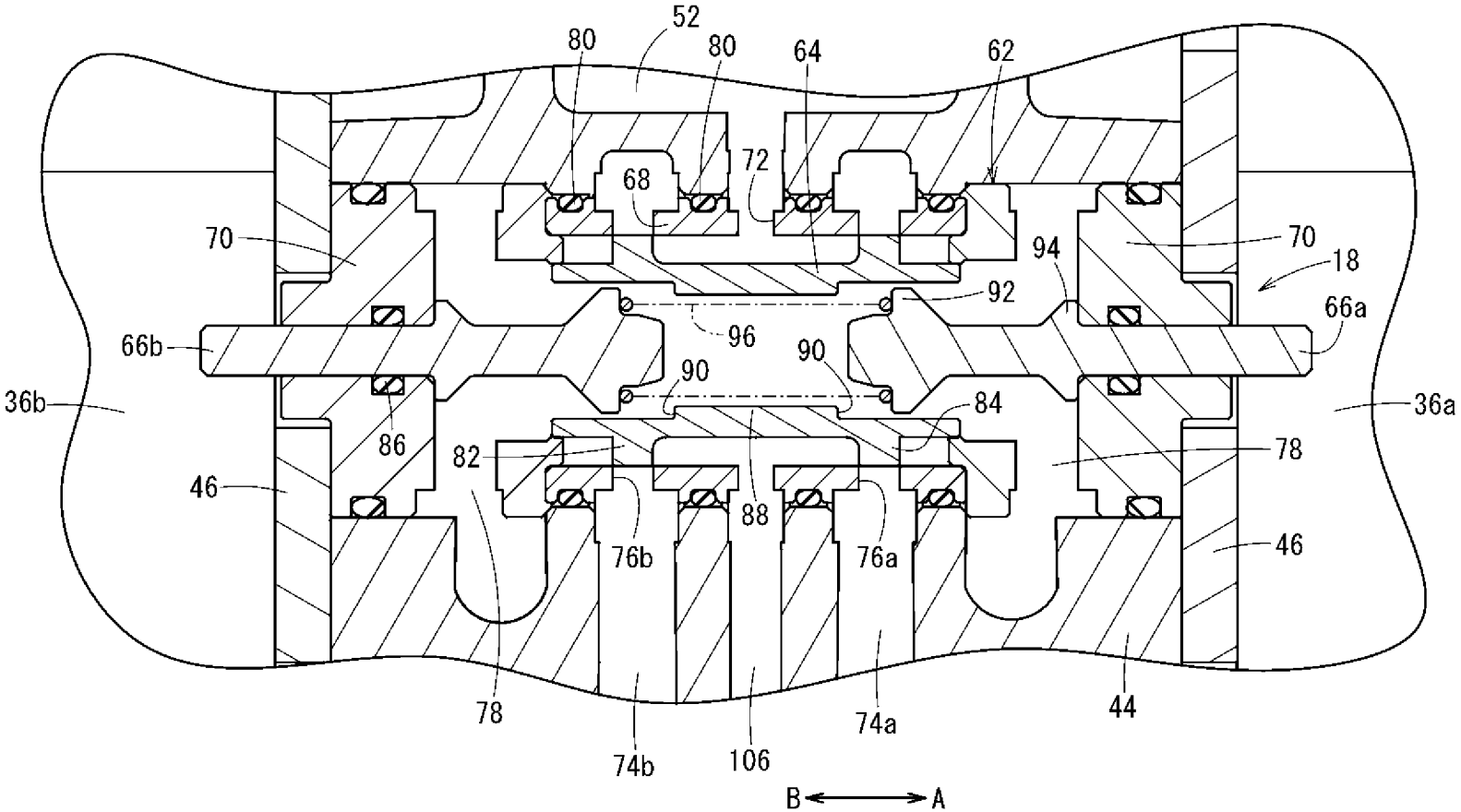
FIG. 5 is a partially enlarged view of part of FIG. 3.

As shown in FIG. 5, the switching valve 18 is equipped with a valve body assembly 62 incorporated into the center body 44 by the use of the side plates 46, a spool 64 slidable in the valve body assembly 62, and a pair of push rods 66*a*, 66*b* protruding respectively into the respective booster chambers 36*a*, 36*b*. The valve body assembly 62 includes a cylindrical sleeve 68 and a pair of side valve bodies 70 arranged on both sides of the sleeve 68.

The sleeve 68 is provided with an inlet port 72 at a central portion of the axial direction (the arrow A-B direction) and is provided on both sides of the inlet port 72 with a pair of outlet ports 76*a*, 76*b* apart from the inlet port 72 in the axial direction. The inlet port 72 is connected to the supply passage 52, and the respective outlet ports 76*a*, 76*b* are connected to the fluid passages 32*a*, 32*b* through the second passages 74*a*, 74*b*, respectively. Further, the side valve bodies 70, 70 are respectively provided therein with a pair of exhaust passages 78 connected to the exhaust port 48. Between the center body 44 and the valve body assembly 62, sealing members 80 are provided for an airtight sealing between the inlet port 72, the outlet ports 76*a*, 76*b*, and the exhaust passages 78.

The spool 64 is formed in a cylindrical shape and is provided at its outer periphery with a first land portion 82 and a second land portion 84 slidably contacting with an inner peripheral surface of the sleeve 68. When the spool 64 is slid toward the right (the arrow A direction) inside the valve body assembly 62, the first land portion 82 is positioned between the outlet port 76*b* on the left side and the inlet port 72, while the second land portion 84 is positioned between the outlet port 76*a* on the right side and the exhaust passage 78 on the right side. Hereafter, this state is regarded as the spool 64 or the switching valve 18 being located at a "first position" (refer to FIG. 6). When the spool 64 is slid toward the left (in the arrow B direction) inside the valve body assembly 62, the first land portion 82 is positioned between the exhaust passage 78 on the left side and the outlet port 76*b* on the left side, while the second land portion 84 is positioned between the inlet port 72 and the outlet port 76*a* on the right side. Hereafter, this state is regarded as the spool 64 or the switching valve 18 being at a "second position". In this way, it is possible to switch the supply passage 52 and the exhaust passages 78 with respect to the pair of the outlet ports 76*a*, 76*b*.

The respective push rods 66*a*, 66*b* are movably inserted through insertion holes which penetrates central portions of the side valve bodies 70 in the axial direction (the arrow A-B direction), and sealing members 86 are provided between the push rods 66*a*, 66*b* and the side valve bodies 70. The respective push rods 66*a*, 66*b* are, at end portions that protrude on the booster chamber 36*a*, 36*b* sides, abuttable on the pistons 14*a*, 14*b*.

The spool 64 is provided at its inner peripheral surface with a small-diameter portion 88 that protrudes radially inward and extends over a predetermined length in the axial direction. Thus, the spool 64 is provided at its inner peripheral surface with a pair of step portions 90. Mutually facing end portions of the pair of push rods 66*a*, 66*b* are inserted into the spool 64, and respective push rods 66*a*, 66*b* are engageable with the step portions 90 of the spool 64 at first flange portions 92 formed at the end portions, respectively. The respective push rods 66*a*, 66*b* are provided with second flange portions 94 at portions close to central portions of the axial directions and are restrained from moving toward the booster chamber 36*a*, 36*b* sides of the push rods 66*a*, 66*b* due to the abutment of the second flange portions 94 on the side valve bodies 70, respectively. A return spring 96 is provided between mutually facing end portions of the pair of push rods 66*a*, 66*b*.

As shown in FIG. 3, a reset valve 98 including a valve body 100 and a reset button 102 is attached to the center body 44. The reset valve 98 is constituted as a normally closed valve that is switchable to a communication state or a cutoff state between a third passage 106 connected to the supply passage 52 and the second passage 74*a* connected to the fluid passage 32*a*. The valve body 100 receives an urging force of a spring 104, so that usually, the reset valve 98 stays at a cutoff position. When the worker pushes the reset button 102, the valve body 100 is pushed by the reset button 102 to be moved against the urging fore of the spring 104. Thus, the third passage 106 is brought into communication with the second passage 74*a*, whereby the pressure fluid from the compressor is directly introduced into the drive chamber 34*a*.

Figure 6:
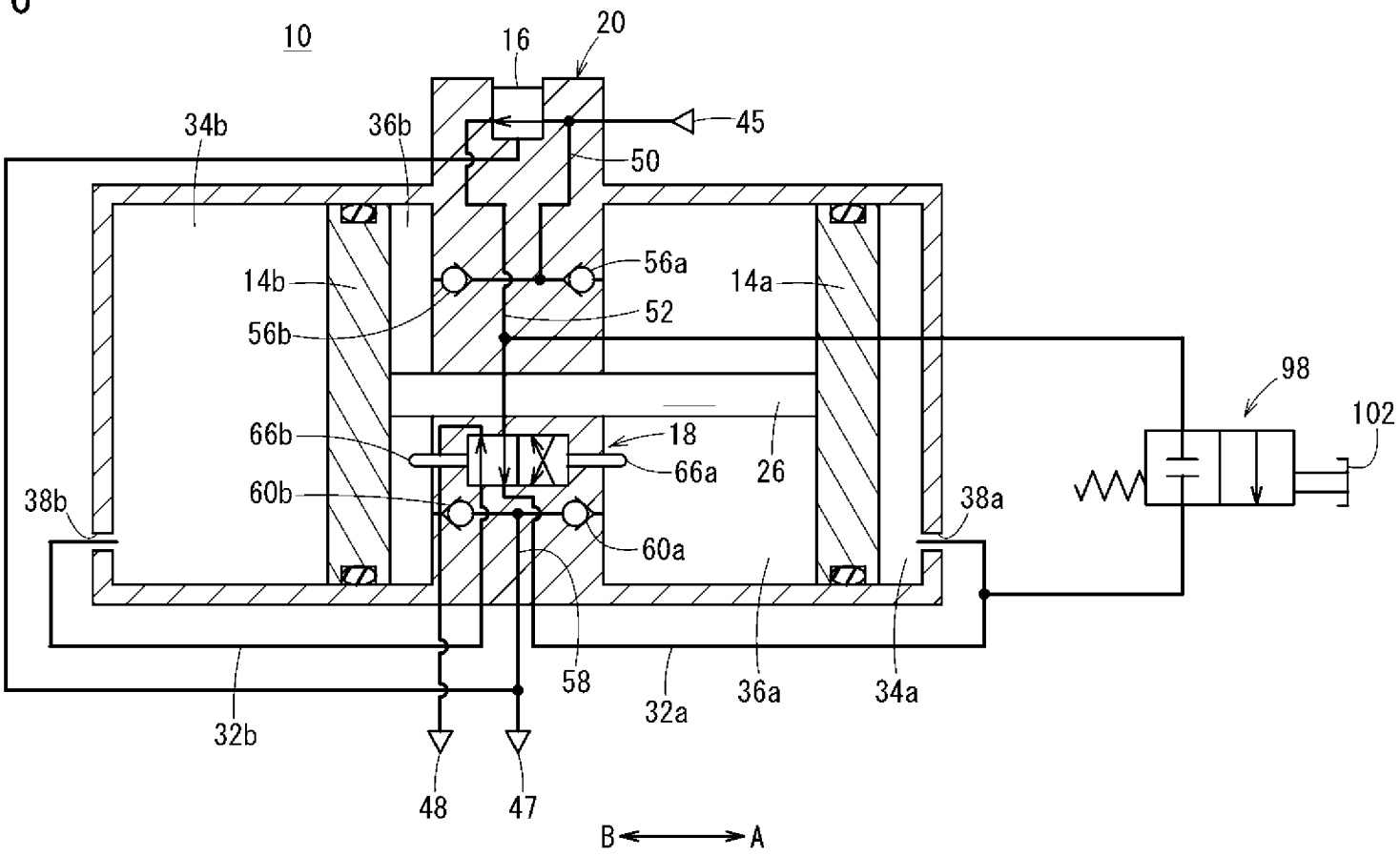
FIG. 6 is a schematic view in which the entire pressure booster shown in FIG. 1 is illustrated with a circuit diagram.

The pressure booster 10 according to the first embodiment of the present invention is basically constructed as described above. Next, the operation and operational effects will be described. Incidentally, an initial position is assumed to be the state that as shown in FIG. 6, the switching valve 18 is at the first position and that the piston 14*a* has been moved to the end plate 22*a* side (in the arrow A direction).

At this initial position, the second land portion 84 of the spool 64 is located between the outlet port 76*a* on the right side and the exhaust passage 78 on the right side, and the outlet port 76*a* on the right side is in communication with the inlet port 72. That is, the fluid passage 32*a* is connected to the supply passage 52 through the second passage 74*a*. Further, the first land portion 82 of the spool 64 is located between the outlet port 76*b* on the left side and the inlet port 72, and the outlet port 76*b* on the left side is in communication with the exhaust passage 78 on the left side. That is, the fluid passage 32*b* on the other side is connected to the exhaust passage 78 through the second passage 74*b*.

At this initial position, pressure fluid is supplied from the compressor (not shown) to the supply port 45, and thus, the pressure fluid flows into the lead-in passage 50 and is led to the booster chambers 36*a*, 36*b* respectively through the first check valves 56*a*, 56*b*.

Part of the pressure fluid supplied from the supply port 45 is regulated in flow rate by the regulating valve 16 and flows to the switching valve 18 through the supply passage 52. Then, the pressure fluid is supplied to the fluid passage 32*a* through the switching valve 18 held at the first position and is further supplied to the drive chamber 34*a*.

The pressure fluid led to the drive chamber 34*a* presses the piston 14*a* toward the center unit 20 side (in the arrow B direction), and thus, the pressure fluid in the booster chamber 36*a* is boosted by the piston 14*a*. The pressure fluid thus boosted is led through the second check valve 60*a* and is outputted by being led from the lead-out passage 58 to the output port 47.

On the other hand, the sliding of the piston 14*b* moved integrally with the piston 14*a* makes the volume of the drive chamber 34*b* smaller, and thus, the pressure fluid in the drive chamber 34*b* is led to the exhaust passage 78 through the fluid passage 32*b* and the switching valve 18 being at the first position and is discharged from the exhaust port 48.

Then, when moved toward the center unit 20 side (in the arrow B direction) up to the end position, the piston 14*a* abuts on the push rod 66*a* of the switching valve 18 to press the push rod 66*a*. As a result, the push rod 66*a* is engaged with the spool 64 at the first flange portion 92 and moves the spool 64 to the second position. That is, the switching valve 18 is switched to the second position.

This time, the pressure fluid supplied to the supply passage 52 is supplied to the fluid passage 32*b* and the drive chamber 34*b* through the switching valve 18 being at the second position, and thus, the piston 14*b* is moved toward the center unit 20 side (in the arrow A direction). Thus, the pressure fluid in the booster chamber 36*b* is boosted, and the pressure fluid thus boosted goes through the second check valve 60*b* and is outputted from the output port 47. When moved toward the center unit 20 side (in the arrow A direction) up to the end position, the piston 14*b* presses the push rod 66*b*. This results in switching the switching valve 18 again to the first position, whereby the pressure fluid is supplied to the drive chamber 34*a*. In the same manner as described above, the piston 14*a* and the piston 14*b* integrally repeat the reciprocating motion, whereby the boosted pressure fluid is continuously outputted from the output port 47.

Here, it may be the case that the thrust or driving force of the pistons 14*a*, 14*b* becomes insufficient due to the pressure of the pressure fluid supplied being low, the pressure difference being small between the booster chambers 36*a*, 36*b* and the drive chambers 34*a*, 34*b*, or a back pressure exerted on the exhaust port 48. Further, the sliding resistance of the pistons 14*a*, 14*b* or the switching valve 18 may become large.

In the case like this, the spool 64 may remain stopped at an intermediate position between the first position and the second position. In this state, it is assumed that the first land portion 82 is at a position overlapping with the outlet port 76*b* on the left side and hence that an imperfect cutoff state has arisen between the inlet port 72 and the outlet port 76*b* on the left side and between the outlet port 76*b* on the left side and the exhaust passage 78 on the left side. Likewise, it is assumed that the second land portion 84 is at a position overlapping with the outlet port 76*a* on the right side and hence that an imperfect cutoff state has arisen between the inlet port 72 and the outlet port 76*a* on the right side and between the outlet port 76*a* on the right side and the exhaust passage 78 on the right side.

When the worker pushes the reset button 102 in the aforementioned state, the pressure fluid from the compressor is introduced directly to the drive chamber 34*a*. As a result, the piston 14*a* is pressed toward the center unit 20 side, whereby the pressure booster 10 is restarted.

According to the pressure booster 10 of the present embodiment, the manually operable reset valve 98 is disposed in a passage connecting the supply port 45 and the drive chamber 34*a*, and thus, the restarting can easily be made even when the switching valve 18 is stopped at the neutral position due to a drop in the fluid pressure supplied thereto or the like.

Figure 7:
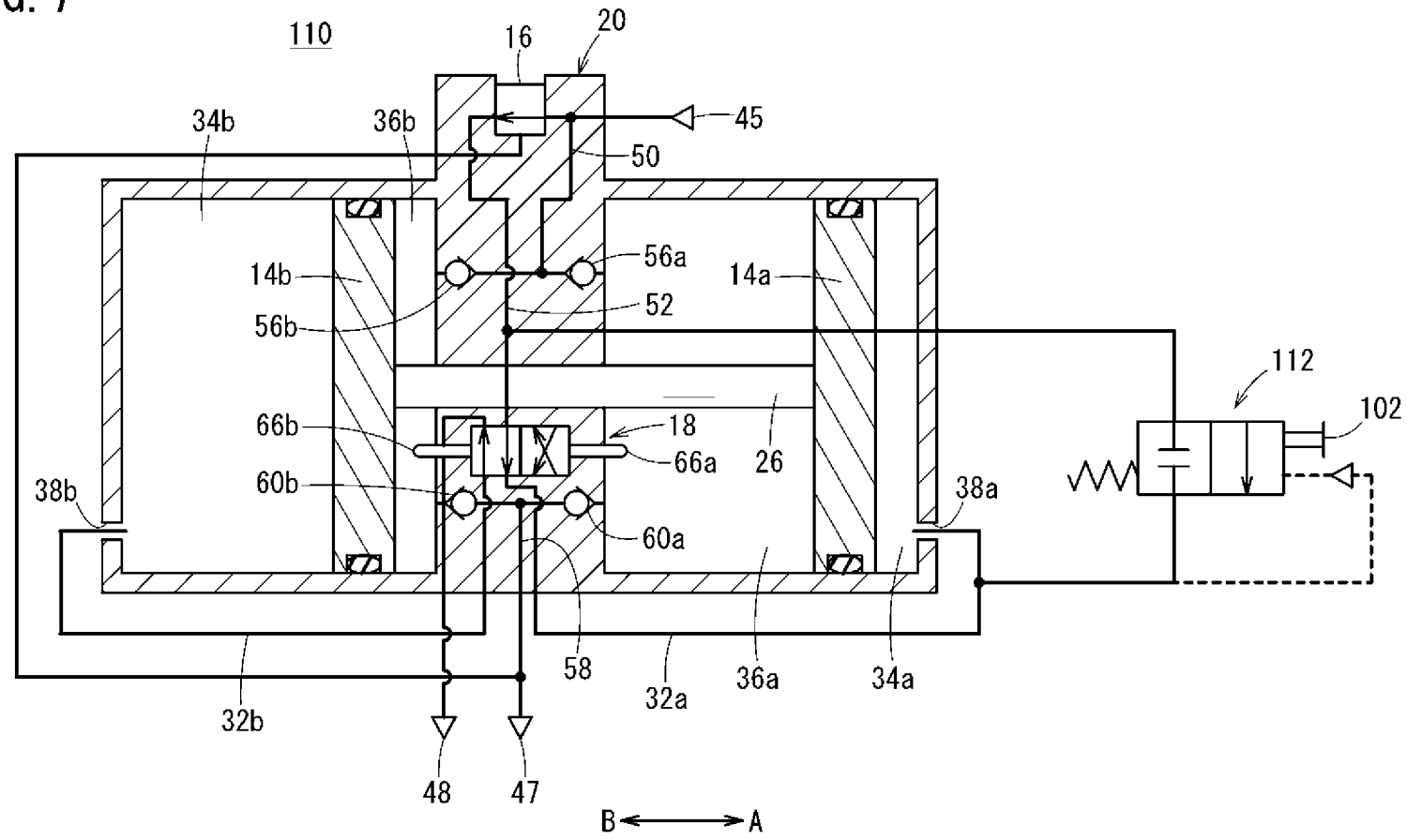
FIG. 7 is a schematic view in which the entire pressure booster according to a second embodiment of the present invention is illustrated with a circuit diagram.

Next, with reference to FIG. 7, description will be made regarding a pressure booster 110 according to a second embodiment of the present invention. The pressure booster 110 has a reset valve 112 which differs in construction from the reset valve 98 of the first embodiment. Incidentally, the same components as those of the pressure booster 10 according to the first embodiment are given the same reference numerals and will be omitted from being described in detail.

The reset valve 112 is constructed as a normally closed valve which is switchable to a communication state or a cutoff state between the supply passage 52 and the fluid passage 32*a*, and the fluid pressure in the fluid passage 32*a* acts as a pilot pressure. That is, the reset valve 112 operates to be switched to a communication position when the fluid pressure in the fluid passage 32*a* is higher than a predetermined value.

Further, the pushing by the worker of a reset button 102 enables the supply passage 52 to communicate with the fluid passage 32*a*, so that it also becomes possible to directly introduce the pressure fluid from the compressor to the drive chamber 34*a*.

According to the pressure booster 110 of this second embodiment, the reset valve 112 operates to be switched to the communication position by receiving as the pilot pressure the fluid pressure in the drive chamber 34*a*. Therefore, even when the switching valve 18 is stopped at the neural position, the switching valve 18 operates when the fluid pressure in the drive chamber 34*a* is higher than the predetermined value, so that the pressure booster 110 is restarted.

The pressure booster according to the present invention is not limited to the foregoing embodiments. It is needless to say that the present invention can take various constructions without departing from the gist of the present invention.

The invention claimed is:

1. A pressure booster comprising:

a center unit;

a pair of cylinders provided on both sides of the center unit;

a pair of pistons, each one of the pair of pistons disposed inside a respective one of the pair of cylinders;

a piston rod connecting the pair of pistons;

a supply port supplied with pressure fluid;

an output port for outputting boosted pressure fluid; and an exhaust port for discharging the pressure fluid;

wherein the cylinders each have a booster chamber and a drive chamber partitioned by one of the par of pistons; and wherein the pressure booster further comprises:

a switching valve that is switched by abutting on each of the pistons to make one or the other of the drive chambers communicate with the supply port and to make the other or the one of the drive chambers communicate with the exhaust port; and a reset valve disposed in a fluid passage connecting the supply port and one of the pair of drive chambers, wherein the reset valve is constructed as a normally closed valve switchable to a communication state or a cutoff state between the supply port and one of the pair of drive chambers, and is manually switchable to a communication position.

2. The pressure booster according to claim 1, wherein the switching valve is incorporated into the center unit and includes:

a pair of push rods respectively abuttable on the pistons; and a spool slid by the pair of push rods.

3. The pressure booster according to claim 1, wherein:

the reset valve operates to be switched to the communication position when receiving as a pilot pressure the fluid pressure in the drive chamber.

4. The pressure booster according to claim 1, wherein:

the reset valve is incorporated into the center unit.

* * * * *